United States Patent [19]

Shores et al.

[11] Patent Number: 4,662,626

[45] Date of Patent: May 5, 1987

[54] PAPER DOCUMENT POCKET FOR RECEIVING AND STACKING SORTED DOCUMENTS

[75] Inventors: Rex W. Shores; Robert H. Martin; George Maclean, all of Oklahoma City, Okla.

[73] Assignee: BancTec, Inc., Dallas, Tex.

[21] Appl. No.: 819,424

[22] Filed: Jan. 16, 1986

[51] Int. Cl.[4] ..... B65H 39/10

[52] U.S. Cl. ..... 271/305; 271/188; 271/209; 271/224; 271/306

[58] Field of Search ..... 271/305, 188, 306, 175, 271/177, 220, 224, 314, 209, 306

[56] References Cited

U.S. PATENT DOCUMENTS

| | | | |
|---|---|---|---|
| 2,944,813 | 7/1960 | Smith | 271/188 |
| 3,087,724 | 4/1963 | Snowdon et al. | 271/220 |
| 3,187,872 | 6/1965 | Hill et al. | 193/16 |
| 3,994,487 | 11/1976 | Wicklund | 271/314 |

FOREIGN PATENT DOCUMENTS

| | | | |
|---|---|---|---|
| 2022563 | 11/1971 | Fed. Rep. of Germany | 271/220 |

*Primary Examiner*—D. C. Butler
*Assistant Examiner*—John A. Carroll
*Attorney, Agent, or Firm*—Bill D. McCarthy

[57] ABSTRACT

A paper document pocket for receiving and stacking sorted documents from a high-speed reader sorter used in the banking industry and similar applications. The pocket is designed to stack in columns paper documents of various sizes and paper weights in sequential order without producing paper jams.

7 Claims, 5 Drawing Figures

PAPER DOCUMENT POCKET FOR RECEIVING AND STACKING SORTED DOCUMENTS

BACKGROUND OF THE INVENTION

This invention relates to a pocket for receiving and stacking various types and sizes of documents and more particularly, but not by way of limitation, to a paper document pocket used with a high-speed reader sorter for reading fields of characters on paper documents either magnetically, optically or both and sorting the documents into a plurality of pockets.

Heretofore, when using high-speed document reader sorters, paper jams and foldovers in the pockets have occurred due to different sizes, thicknesses and paper weights of the documents when the documents are sorted in sequential order.

Prior art reader sorters used for sorting paper documents have used springs, air jets and similar types of devices for holding already pocketed documents out of the path of incoming documents. Springs attempt to deflect documents away from incoming documents. However, static electricity and other causes can compel already pocketed documents to return to contact the spring before another document enters the pocket. Air jets can be used to solve this problem but they are expensive.

Further, prior art pockets quite often have the problem of incoming documents colliding with the tails of documents already in the pocket. These devices usually use a combination of springs to deflect incoming documents out of the path of the documents entering behind the earlier document. Also augers and air jets are commonly used. All of the above-mentioned document pocket devices have the above-mentioned problems.

In the following U.S. patents; U.S. Pat. Nos. 2,904,334 to Rabinow, 2,944,813 to Smith, 2,994,529 to Relis, 3,087,724 to Snowdon et al, 3,187,872 to Hill et al, 3,869,117 to Yoshimura, 4,313,660 to Larson et al, 4,340,213 to Jensen, 4,385,758 to Ellsworth, 4,476,670 to Ukai et al and 4,509,739 to Kurokawa various types of document sorting devices and stacking apparatus are described. None of these earlier patents describe the unique features and advantages of the subject invention.

SUMMARY OF THE INVENTION

The subject paper document pocket for receiving and stacking documents from a high speed reader sorter allows for stacking of different sizes, thicknesses and weight of paper documents in sequential order in the pocket at high speeds without producing jams or foldovers in the pocket area.

The document pocket provides a continuous row of flexible elements which enable incoming documents to pocket without hitting the tails of documents already in the pocket even if the document is crumpled or folded.

Further, the document pocket provides for a low cost effective alternate to air jets, springs and the like to catch and hold documents in place as they are received in the bottom of the pocket housing.

The paper document pocket for receiving and stacking sorted documents from a high speed reader sorter includes a pocket housing having a pocket gate attached thereto for introducing a document into the top of the pocket. A transport drive capstan engages and moves the document into a cupping assembly which is used for cupping the document prior to receipt against an elongated strip of flexible elements used for deflecting the incoming document. The lower portion of the flexible elements which have not been deflected urge the prior document away from the side of the pocket housing preventing the leading edge of the incoming document from contacting the tail of the earlier pocketed document. Attached to the bottom of the housing is a pocket flap having a parallelogram or four bar linkage configuration used for holding a column of the documents as they are received in the bottom of the pocket housing. Attached to the side of the pocket housing, and adjacent the bottom of the housing is a paper clutch having fibers biased downwardly at an angle. The downward bias of the fibers act as a paper clutch by allowing the document to enter and contact the bottom of the pocket but preventing the document from bouncing upwardly as it strikes the bottom of the pocket.

The advantages and objects of the invention will become evident from the following detailed description of the drawings when read in connection with the accompanying drawings which illustrate preferred embodiments of the invention.

DETAILED DESCRIPTION OF THE DRAWINGS

Figure 1:
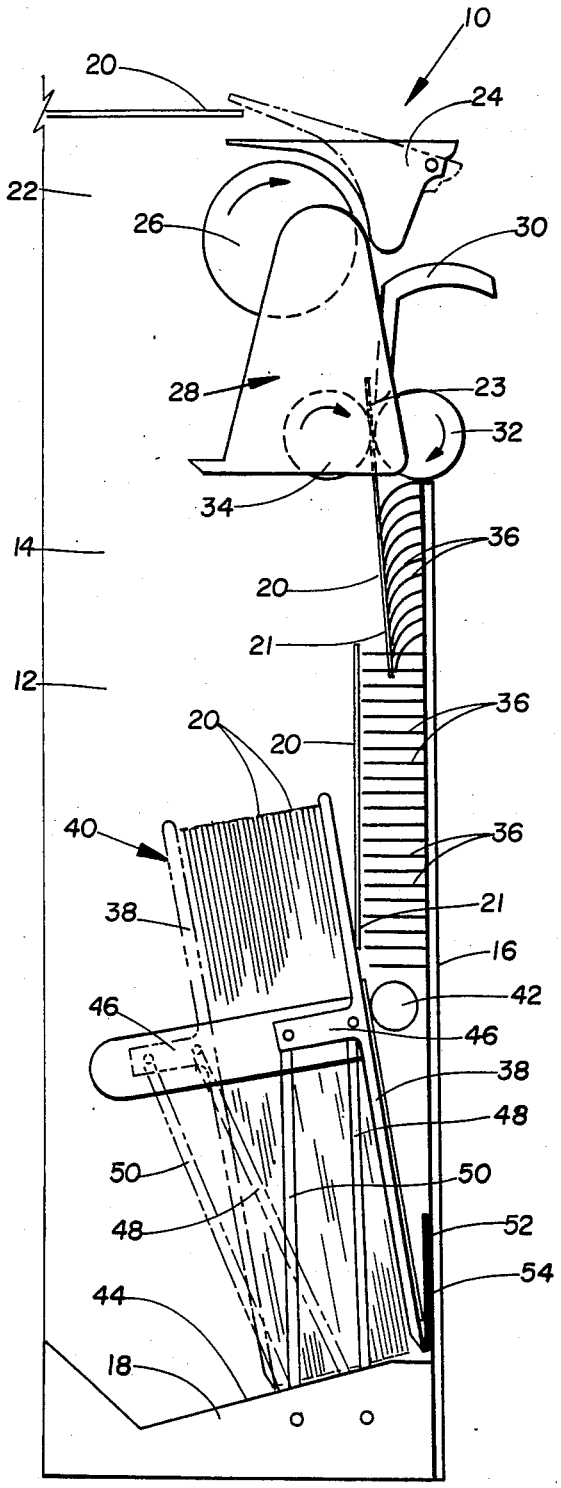
FIG. 1 illustrates a side view of a paper document pocket.

In FIG. 1 the paper document pocket for receiving and stacking sorted documents from a high-speed reader sorter is designated by general reference numeral 10. The pocket 10 includes a housing 12. The housing 12 includes an open front with a rear mounting plate 14, a side plate 16 extending outwardly from the rear plate 14, a bottom tray 18 used for receiving a plurality of sorted documents 20. Attached to a top portion 22 of the housing 12 is a pivotally attached pocket gate 24. The gate when raised as shown in dotted lines directs the document 20 into the pocket housing 12 where it is engaged by a transport drive capstan 26 rotatably mounted on the rear plate 14. The capstan 26 urges the document into a cupping assembly 28 having a lead edge guide 30, an idler roller 32 and a driven pinch roller 34. The assembly 28 is used for cupping the document 20 and is shown in greater detail in FIG. 3.

Attached to the side plate 16 and along its length are a plurality of flexible elements 36 which are disposed perpendicular to the downward travel of the document 20. In FIG. 1 the document 20 can be seen with its leading edge 21 engaged by the flexible elements and bending the elements 36 downwardly. A trailing edge 23 of the document 20 is shown still engaged between the idler roller 32 and the driven pinch roller 34. A second and earlier transported document 20 has been slowed by friction between earlier pocketed documents and the flexible elements 36 with the lower elements 36 moving the document 20 after its trailing edge has left the cupping assembly 28 outwardly and to the left where it is engaged against a pocket flap 38 which is part of a four bar linkage having a general reference numeral 40. A low inertia roller 42 is attached to the side plate 16 and used for engaging the leading edge 21 of the document 20 and urging the document downwardly onto an angled surface 44 with a flat horizontal suface 45 which is part of the bottom tray 18 of the pocket housing 12. Roller 42 provides a low friction means of allowing the document inertia to carry the document fully to the pocket bottom without stopping prior to reaching the pocket bottom 18. The angled bottom surface 44 is parallel to an outwardly extending arm 46 integrally attached to the rear of the pocket flap 38. Attached to the arm 46 and the rear of the bottom tray 18 is a pair of parallel linkage arms 48 and 50. The arms 48 and 50 along with the arm 46 and the angled surface 44 combine to make the four bar linkage 40 or a parallelogram for receiving and stacking the documents as shown in shaded lines 20. In FIG. 1 the flap 38 is shown in solid lines 38 prior to receiving the documents and then move to the left and shown in dotted lines when a stack of documents have been received therein.

Attached to the inside of the side plate 16 is a paper clutch 52 made up of a fabric 54 which is downwardly biased for engaging the documents 20 as they contact the angled surface 44 of the bottom tray pocket 18. The paper clutch 52 is shown in greater detail in FIG. 5.

Figure 2:
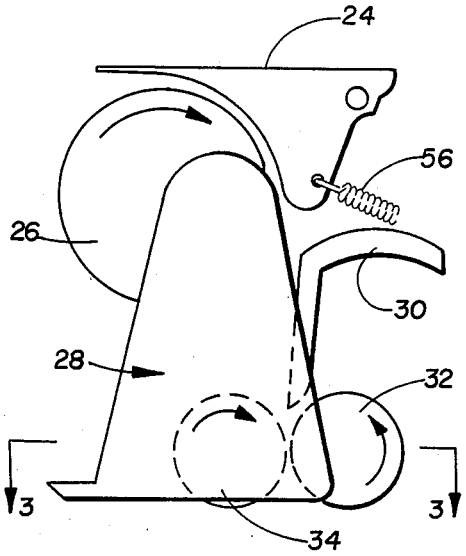
FIG. 2 illustrates an enlarged view of a pocket gate and cupping assembly.

In FIG. 2 the pocket gate 24 is shown in a closed position and engaged by a spring 56 which is used for urging the gate 24 in its down or closed position. Also shown in this enlarged view is the cupping assembly 28 with the lead edge guide 30 which is used for engaging and guiding the document 20 between the driven pinch roller 34 and idler roller 32.

Figure 3:
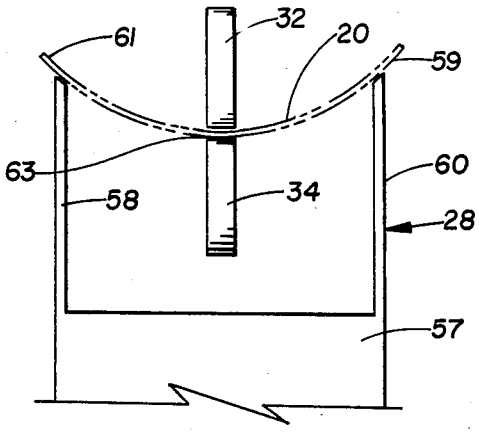
FIG. 3 illustrates a top view of the cupping assembly taken along lines 3—3 shown in FIG. 2.

In FIG. 3 a top view of the cupping assembly 28 is shown having a cupping guide 57 with a pair of outwardly extending arms 58 and 60 which are used to contact opposite sides 59 and 61 of the document 20 and bend or cup the document 20 as its center portion 63 is received between the pinch roller 34 and idler roller 32.

Figure 4:
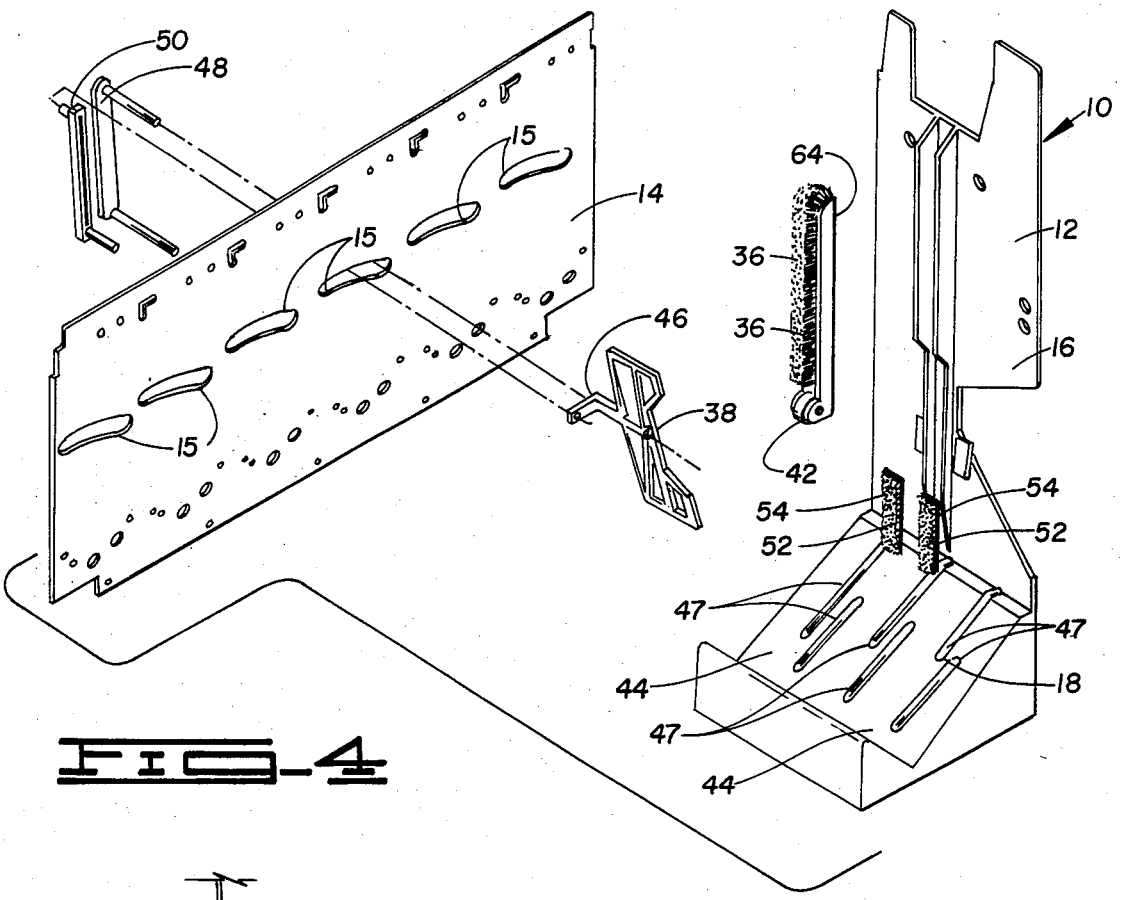
FIG. 4 shows an exploded view of a pocket housing and four bar linkage.

In FIG. 4 an exploded view of the pocket housing 12 is shown with the elongated rear plate 14 used in this illustration for six paper document pockets 10 all similar to the one shown in FIG. 1. Also shown in this view is the four bar linkage 40 made up of the pocket flap 38, the angled bottom tray 18 and the parallel linkage arms 48 and 50. Also shown in this exploded view is the flexible elements 36 mounted in an elongated housing 64 with the low inertia roller 42 mounted on the bottom of the housing 64. Also mounted at the bottom of the side plate 16 is a pair of the paper clutches 52. It should be noted the rear plate 14 includes a plurality of horizontal curved slots 15 for attaching the arms 48 and 50 to the flap 38 and allowing the flap 38 to move to the left as the bottom tray 18 is filled with the documents 20 as shown in FIG. 1.

Figure 5:
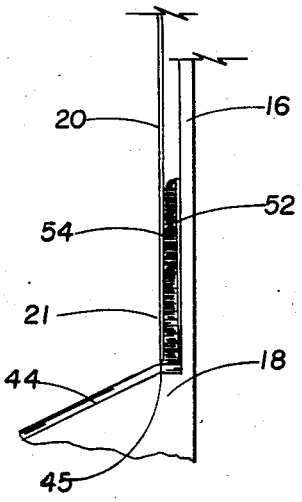
FIG. 5 illustrates an enlarged side view of a paper clutch attached to a side plate of the pocket housing.

In FIG. 5 an enlarged side view of the paper clutch 52 is shown with the downwardly biased fabric 54 attached thereto for engaging the leading edge 21 of one of the documents 20.

In operation, the paper document pocket designated by general reference numeral 10 is used to stack in columns the paper documents 20 of various sizes and paper weights without producing jams and sequentially in the order in which they enter the pocket housing 12. In a typical reader sorter used in the banking industry, the documents 20 are placed in a feed hopper and individually fed into a transport of the reader sorter. After entering the transport, the document goes through an alignment device and enters a reader area. There the document 20 is read and a microprocessor tracts the document 20 as it makes its way along the document transport. The transport and the various reader sorter equipment are not shown in the above-mentioned drawings. As the document 20 nears its designated pocket 10, a microprocessor controller in a stacker module activates a solenoid, connected to the gate 24. The gate 24 opens to allow the document 20 to enter the pocket housing 12. The document 20 next enters the cupping assembly 28. The document 20 emerges from the assembly 28 where it contacts the continuous row of flexible elements 36 with the elements deflected against the downward path of the document 20. The leading document 20 is held away or to the left of the leading edge 21 of the trailing document 20 by the flexible elements 36 which are downstream from the upper deflected elements 36. This action allows the incoming document to slip in front of the previous document without colliding into each other.

As the leading edge 21 of an incoming document 20 reaches the bottom of the pocket housing 12, it comes into contact with the fabric 54 of the paper clutch 52 with the fibers biased at a downward angle. The downward bias of the fabric acts as a paper clutch in that it allows the document 20 to enter the bottom tray 18 but keeps it from bouncing upward as it strikes the flat surface 45 and slides downward on the angled surface 44. As the documents 20 fill the bottom tray 18 they build up a compressive force between the document stack and the pocket structure which impedes the movements of the documents entering the bottom of the housing 12. To reduce this impending friction, the low inertia roller 42 is located at a point in the housing 12 where the compressed stack of documents 20 would normally contact the brush elements 36 attached to the side plate 16.

As the documents 20 are pocketed, they rest against the pocket flap 38 which is part of the four bar linkage 40. The stack of documents ride downwardly on the angled surface 44 and the force of gravity combined with the force created by the incoming documents push the pocket flap 38 to the left as it is filled. The angled surface 44 also includes upwardly extending parallel ribs 47 to reduce document friction and thus reduce pressure in the document stack.

When the pocket tray 18 is full, a switch is activated by an acutator arm resting on a rear linkage and signals a pocket full situation to a microprocessor control.

Changes may be made in the construction and arrangement of the parts or elements of the embodiments as described herein without departing from the spirit or scope of the invention as defined in the following claims.

What is claimed is:

1. A paper document pocket for receiving and stacking sorted documents, the pocket comprising:

a pocket housing having a rear plate, a side plate extending outwardly from the rear plate, and a bottom tray for receiving a document therein;

means for receiving and directing a transported document into the top of the housing and attached thereto;

cupping means attached to the top of the housing for cupping the document as it is received in the housing;

flexible elements attached to the side plate of the housing and engaging the document when it is discharged from the cupping means;

a pocket flap pivotally attached to the rear plate of the housing and adjacent the bottom tray for holding the stacked documents as they are received in the bottom tray; and a paper clutch attached to the side plate and adjacent the bottom tray to prevent the document from bounding upwardly when a leading edge of the document contacts the bottom tray.

2. A paper document pocket for receiving and stacking sorted documents, the pocket comprising:

a pocket housing having a rear plate, a side plate extending outwardly from the rear plate, and a bottom tray for receiving a document therein;

a gate pivotally attached to the top of the rear plate and a main transport capstan rotatably mounted on the rear plate and adjacent the gate for receiving and directing a transported document into the top of the housing;

cupping means attached to the top of the housing for cupping the document as it is received in the housing;

flexible elements attached to the side plate of the housing and engaging the document when it is discharged from the cupping means; and a pocket flap pivotally attached to the rear plate of the housing and adjacent the bottom tray for holding the stacked documents as they are received in the bottom tray.

3. The pocket as described in claim 1 wherein the cupping means includes a lead edge guide for guiding the document between an idler roller and a driven pinch roller, the idler roller and driven pinch roller disposed between a cupping guide having outwardly extending arms for engaging the sides of the document with the center of the document engaged between the idler roller and the driven pinch roller.

4. The pocket as described in claim 1 further including a low inertia roller rotatably attached to the side plate and disposed below the flexible elements for engaging the document as the document is received and compressed against the pocket flap.

5. The pocket as described in claim 1 wherein the pocket flap is part of a four bar linkage, the four bar linkage made up of an outwardly extending arm integrally attached to the rear of the pocket flap and a pair of parallel link arms attached to the outwardly extending arm and the bottom of the rear plate.

6. A paper document pocket for receiving and stacking sorted documents, the pocket comprising:

a pocket housing having a rear plate, a side plate extending outwardly from the rear plate, an open front and a bottom tray for receiving a document thereon;

a pivotally mounted gate attached to the top of the rear plate of the housing for engaging and directing a transported document into the top of the housing;

a main transport capstan attached to the rear plate for urging the document downwardly into the pocket housing;

cupping means attached to the top of the housing for cupping the document as it is received from the main transport capstan;

flexible elements attached to the side plate of the housing and engaging the document as it is discharged downwardly from the cupping means, the flexible elements extending outwardly in the direction of travel of the document;

a paper clutch attached to the bottom of the side plate and adjacent the bottom tray for engaging a leading edge of the document as the document contacts the bottom tray; and a pocket flap pivotally attached to the rear plate of the housing and adjacent the bottom tray for holding the documents in the bottom tray.

7. The pocket as described in claim 6 wherein the pocket flap includes an outwardly extending arm attached to the rear of the pocket flap, the arm pivotally attached to one end of a pair of parellel link arms, the other end of the link arms pivotally attached to the bottom of the rear plate of the housing, the outwardly extending arm and the bottom tray forming a parallelogram with the parallel link arms.

* * * * *